United States Patent [19]

Foederer

[11] 4,368,939

[45] Jan. 18, 1983

[54] MODULAR CONNECTOR HOUSING

[75] Inventor: Wilhelmus T. M. Foederer, Best, Netherlands

[73] Assignee: E. I. Du Pont de Nemours and Company, Wilmington, Del.

[21] Appl. No.: 141,666

[22] Filed: Apr. 18, 1980

[51] Int. Cl.[3] ..... H01R 13/48

[52] U.S. Cl. ..... 339/59 M; 339/207 R

[58] Field of Search ..... 339/49 R, 31 R, 31 M, 339/198 G, 198 H, 206 R, 59, 47–49, 198 P, 198 S, 196, 207, 208

[56] References Cited

U.S. PATENT DOCUMENTS

| | | | |
|---|---|---|---|
| 2,469,397 | 5/1949 | Mezek | 173/328 |
| 2,928,066 | 3/1960 | Gordon | 339/198 |
| 3,253,252 | 5/1966 | Piperato et al. | 339/198 |
| 3,259,870 | 7/1966 | Winkler | 339/49 |
| 3,456,231 | 7/1969 | Paullus et al. | 339/60 |
| 3,537,061 | 10/1970 | Haag et al. | 339/31 M |
| 3,538,489 | 11/1970 | Bennett et al. | 339/198 H |
| 3,676,833 | 7/1972 | Johnson | 339/49 R |
| 3,701,087 | 10/1972 | Bernard | 339/198 G |
| 3,781,760 | 12/1973 | Mancini et al. | 339/59 M |
| 3,789,343 | 1/1974 | Hirokawa | 339/49 R |
| 3,884,544 | 5/1975 | Lundergan et al. | 339/198 G |

*Primary Examiner*—Joseph H. McGlynn

[57] ABSTRACT

A multiplicity of modules slidably engaged by a key and slot assembly to form a connector housing. Each module contains at least two rows of connector blocks containing terminal receiving channels.

5 Claims, 7 Drawing Figures

Legend:
≈ - SPACE AREA

MODULAR CONNECTOR HOUSING

DESCRIPTION

TECHNICAL FIELD

This invention relates to electrical connector housings. More particularly, it refers to a modular dielectric connector housing adapted to receive multiple terminals.

BACKGROUND

Many different housings have been created to retain electrical terminals. In U.S. Pat. No. 2,469,397 multiple connectors are stacked in a housing. The stacked connectors are held together by clamping or strap means. In U.S. Pat. No. 2,928,066 housing blocks containing electrical terminals are interlocked using cylindric tongues and cylindric recesses. U.S. Pat. No. 3,253,252 describes sectional terminal blocks. Each connector has a key along one side of its housing and a corresponding slot on the opposite side. No modular units are employed. U.S. Pat. No. 3,259,870 describes individual connector units having dovetail tongues and correspondingly shaped grooves on opposite sides that allow interlocking connectors.

The following additional U.S. Pat. Nos. also show various systems of joining electrical connectors: 3,456,231; 3,676,833; 3,701,087; 3,789,343; 3,884,544. All of these interlocking connectors are limited in their versatility. What is needed is an easily separable and joinable series of connector units that provide an infinite number of possible combinations of connector blocks enclosing electrical terminals.

SUMMARY OF THE INVENTION

In accordance with my invention, there is provided a multiplicity of modules slidably engaged to form a unified connector housing. Each module contains six or more connector blocks adapted to receive electrical terminals. Identical modules can be slidably engaged. Each module has a first complete row of integrally joined connector blocks and at least one second row of intermittently spaced apart blocks integrally molded to the first row of blocks. Two modules are engaged by sliding the intermittent blocks from one module into the spaces between the intermittent blocks in a second module. Each side of each space between blocks has either a key or a slot to that a key of one module is slidably engaged in a slot of the second module as the modules are engaged. The friction fit between the several key and slot assemblies retains the modules in the desired joined position. Each block in the respective modules contains a terminal receiving channel open at both ends for retention of an electrical terminal. A terminal stamped from a conductive material such as phosphor bronze or copper is retained in the channel by a friction fit or a retaining latch. This assembly provides for an infinite number of connector blocks that are easily stacked vertically or horizontally and can be quickly joined together or taken apart.

BRIEF DESCRIPTION OF THE DRAWINGS

The invention is illustrated in the accompanying drawings wherein:

FIG. 3 is a perspective view of two modified modules ready for joining. Each connector block contains a terminal retention latch.

DESCRIPTION OF THE PREFERRED EMBODIMENTS

Figure 1:
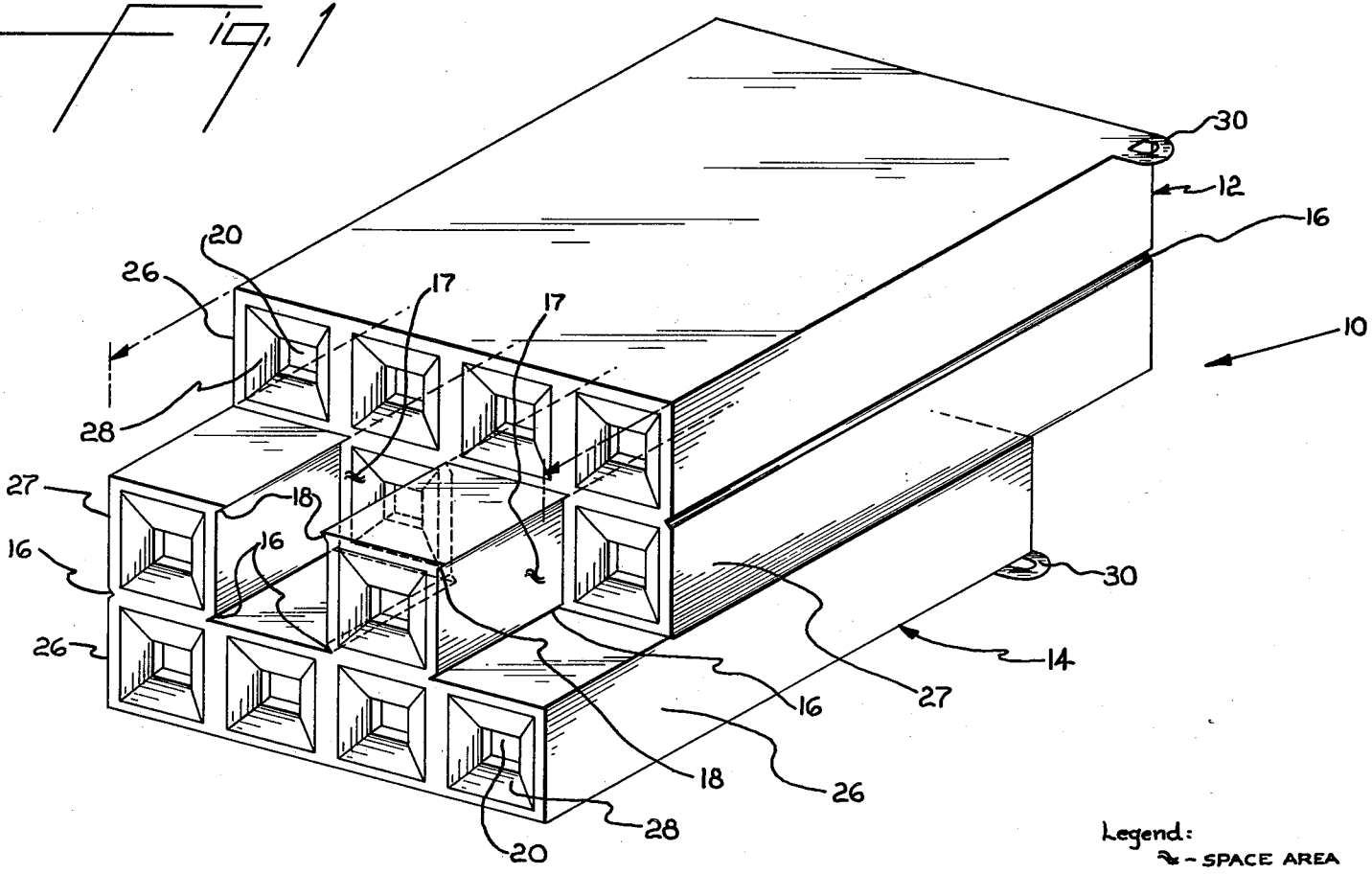
FIG. 1 is a perspective view of two modules being slidably engaged and showing the relationship between the two modules.

The dielectric connector housing of this invention provides the means to fabricate from an infinite variety of individually molded modular units a series of vertically or horizontally stacked connector blocks that are easily joined together and likewise are easily taken apart. An example of an identical pair of modular units used to form three rows of four connector blocks per row is shown in FIG. 1. The dielectric connector housing is denoted by the reference numeral 10. The connector housing 10 is made by slidably engaging a top module 12 and a bottom module 14. Each identical module, 12 an 14, in FIG. 1 has a first complete row of blocks 26 and a second row of intermittently spaced blocks 27. Spaces 17 between the blocks 27 in module 12 are adapted to receive blocks 27 from the module 14. Slots 16 and keys 18 are located in both modules in the spaces 17. Each key 18 from the bottom module 14 slides into a slot 16 from the top module 12 as the two modules are slid together. At the same time, each key 18 from the top module 12 slides into a slot 16 in the bottom module. The two modules lock together by the combined deformation of the keys and corresponding slots over their entire length. A hold down fastner 30 may be molded to each module to provide a means for securing the housing to another housing or electrical assembly.

Each module 12 and 14, has a multiplicity of elongated terminal receiving channels 24. See FIG. 5. These channels 24 have openings 20 and 22 at each end. The elongated channels 24 within each module are designed to accommodate a specific terminal such as 42. In FIG. 1 the terminal employed would be joined to a pin. To accommodate this pin the opening 20 has chamfered surfaces 28 leading into the channel.

Figure 2:
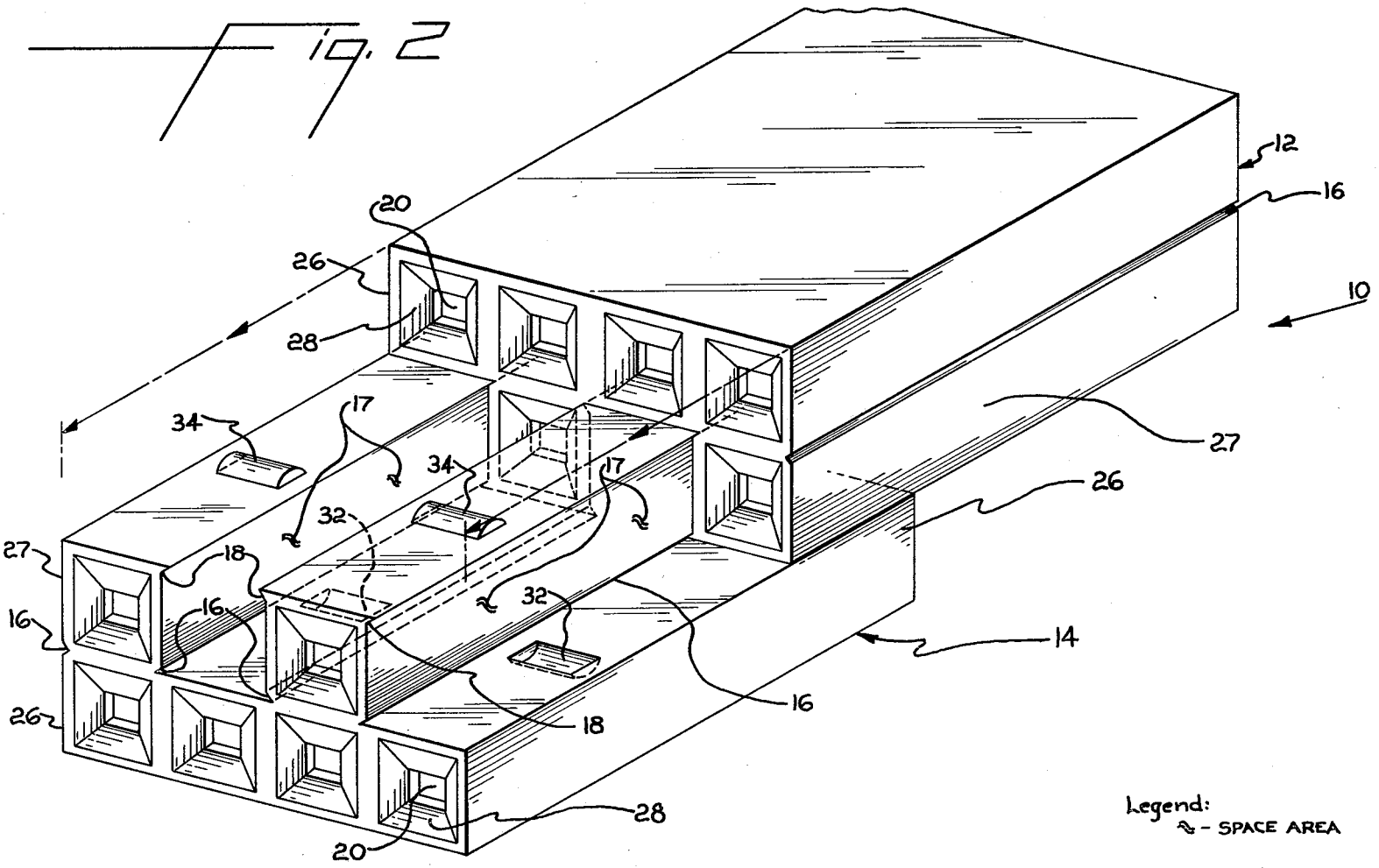
FIG. 2 is a perspective view of a variant. Two modules are shown being slidably engaged. Locking devices provide additional assurance against accidental disengagement.

In modifications of the invention, there may be added a latch 34 and a notch 32 as shown in FIG. 2. These latches prevent accidental or inadvertent separation of the two modules. Although FIG. 2 shows the latch 34 in the blocks of the second row 27 and the notch in the blocks of the first row 26, this can be reversed as desired.

Figures 1, 4:
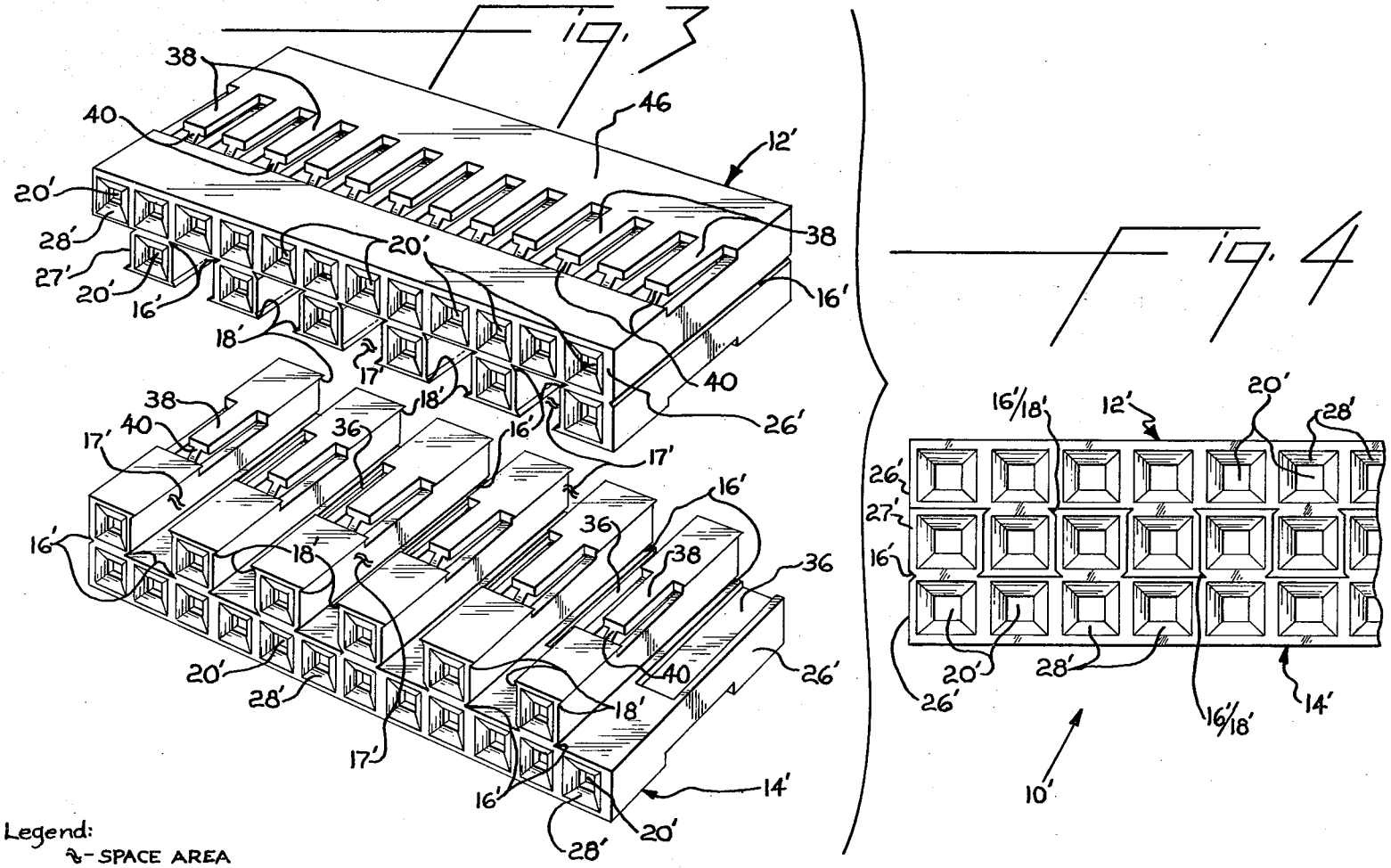
FIG. 4 is a fragmentary frontal view of a portion of the two modules of FIG. 3 joined together.

Modifications can be made in the modules such as shown in FIGS. 3 and 4, to provide for specific types of terminals. In this modification, a groove 36 is made in the connector block surface defining the floor of the space 17. This groove 36 provides an area into which a latch arm 38 from a mating connector block can move as a terminal 42 is inserted into the channel 24 from the opening 22. The latch arms 38 are molded into an outside surface 46 of the modules 12' and 14'. The connector block configuration corresponds to the connector block shown in U.S. Pat. No. 3,781,760. The description of the connector block of U.S. Pat. No. 3,781,760 is herein incorporated by reference.

Figure 5:
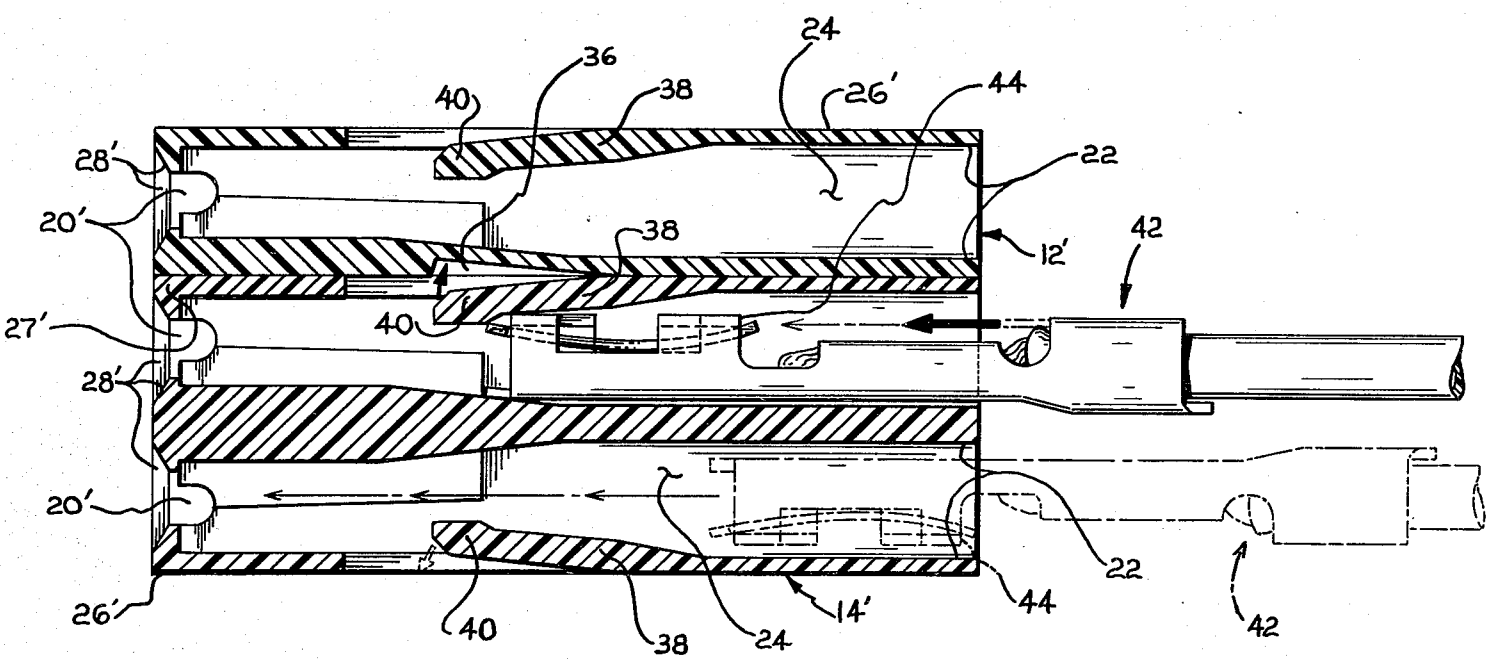
FIG. 5 is a transverse sectional view of a connector channel from the FIG. 3 modules with a view of a terminal being inserted into the channel.

As shown in FIG. 5 the individual connector blocks within the module have a latching arm 38 supporting a latch nose 40 which abuts the terminal 42 at seat 44 when the terminal is fully inserted into channel 24. A terminal 42 is inserted into the back end through opening 22 of each connector block 26' or 27' into a channel 24. When the latch is in place behind seat 44 the terminal cannot be removed without moving the latch nose 40 from the seat 44. As can be seen in FIG. 5, the terminals are inserted in an upside down direction in the lower connector block 26' of each module so that the latch arm 38 has the ability to move outwardly from the connector block as the terminal is inserted.

Figure 6:
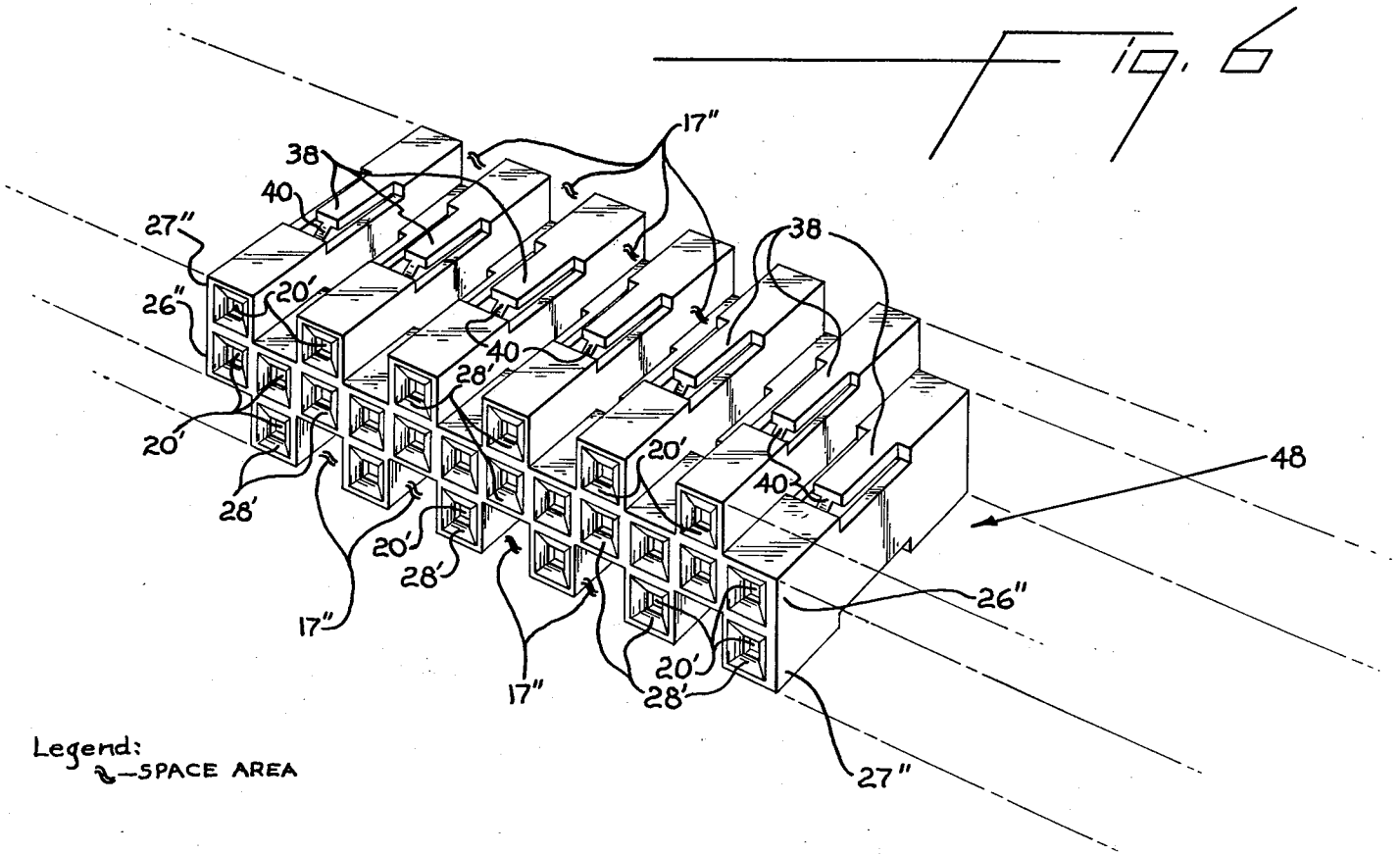
FIG. 6 is a perspective view of a further modified middle module that can be used in a connector assembly having at least five stacked rows of connector blocks.

FIG. 6 shows a three row intermediate connector block module 48 which can be mated with the connector block modules shown in FIG. 3 to form a five row modular dielectric connector housing. In module 48 the complete row of blocks 26'' is in the middle and is integrally molded to two rows of intermittently spaced blocks 27''. The spaces 17'' in the rows 27'' receive modules such as 12' and 14' from FIG. 3. The rows 27' contain blocks that fit into the spaces 17''. In like manner the blocks in rows 27'' of module 48 fit into the corresponding spaces 17' in rows 27' of modules 12' and 14'.

Figure 7:
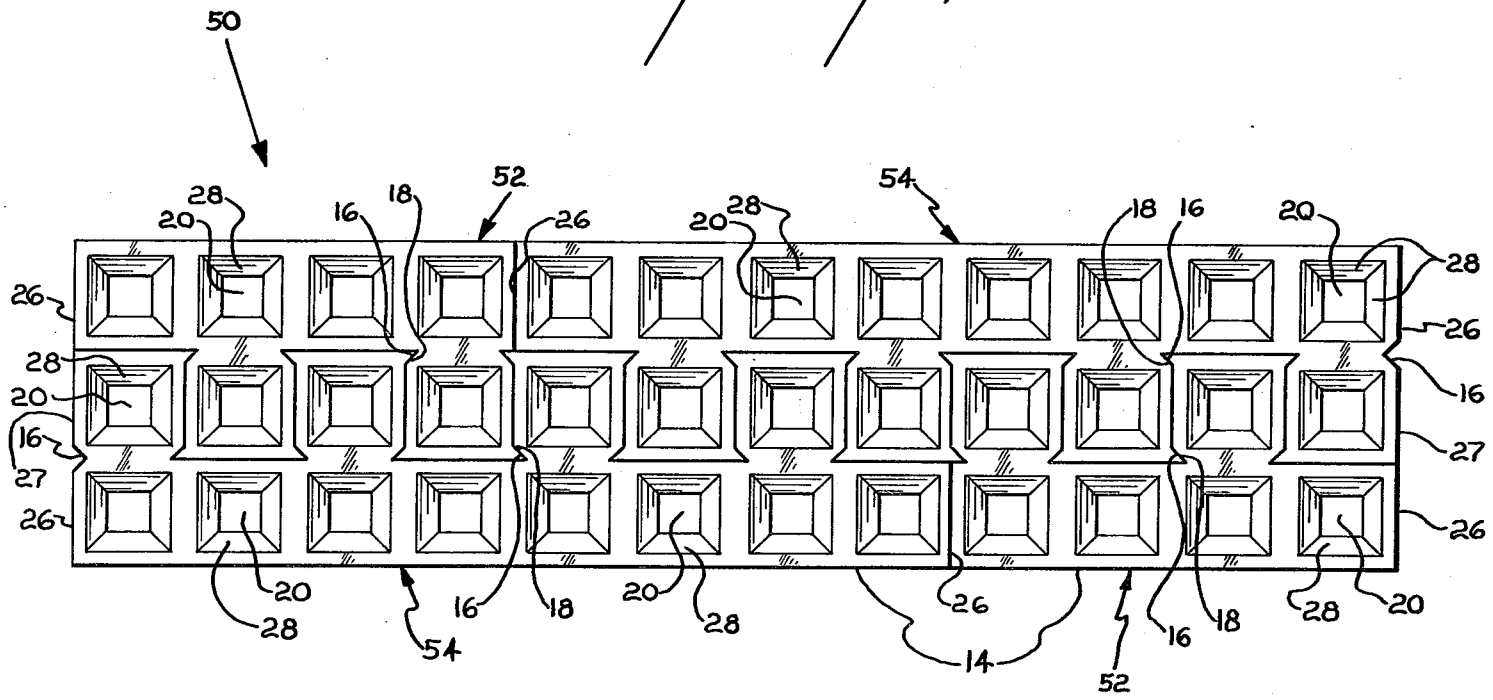
FIG. 7 is a frontal view of another modification with four modules joined together. Two pairs of different module configurations provide three stacked rows of twelve connector blocks per row.

FIG. 7 shows an additional three row modular dielectric connector housing 50 in which two identical modules 52, each containing six connector blocks, are slidably engaged with two identical modules 54 each containing twelve connector blocks.

As can be understood from the drawings and description, the pairs of modules such as 12 and 14 are hermaphroditic. Each contains slots 16 and keys 18 in order to accommodate a mating of the two modules. In most instances the terminals 42 are slid into the channels 24 from the rear. However; variations in this can be easily achieved. Different combinations of modules can be used as would be obvious to provide modular dielectric connector housings of various numbers of horizontally and vertically stacked connector blocks. When the desired number of connector blocks are an uneven number, the two opposing modules at the ends are not hermaphroditic.

The modules are made in a standard mold using any of the conventional dielectric plastics such as polyethylene-terephthalate, polycarbonate or polyethylene.

The connector housings can be used in many types of electronic devices, including computers and radio equipment.

I claim:

1. A dielectric connector housing comprising at least two identical modules slidably engaged together, each module having a first complete row of blocks and at least one second row of intermittently spaced apart blocks integrally molded to said first row of blocks, each space of one module adapted to receive a corresponding block from the other module, each block containing a terminal receiving channel open at both ends and adapted to receive an electrical terminal.

2. A dielectric connector housing according to claim 1 wherein a third module having a complete middle row of blocks and intermittently spaced apart blocks integrally molded to each side thereof is slidably engaged between the two identical modules.

3. A dielectric connector housing according to claim 1 wherein one opening to the terminal receiving channel has chamfered edges for alignment of terminal receiving pins.

4. A dielectric connector housing according to claim 1 wherein each intermittently spaced apart block has a top surface containing a latch for engagement with a notch on a lower exposed surface of the complete row of blocks.

5. A dielectric connector housing according to claim 1 wherein at least one block has a flexible latch extending into the terminal receiving channel, said latch being in the path of withdrawal of a terminal seated in said channel.

* * * * *